US005168121A

United States Patent [19]

Maynard

[11] Patent Number: 5,168,121

[45] Date of Patent: Dec. 1, 1992

[54] AUTOLOADING APPARATUS FOR LARGE CALIBER RAPID FIRE GUNS

[75] Inventor: Alfred C. Maynard, Pittsfield, Mass.

[73] Assignee: General Electric Company, Pittsfield, Mass.

[21] Appl. No.: 772,754

[22] Filed: Oct. 7, 1991

[51] Int. Cl.[5] ..... F41A 9/43

[52] U.S. Cl. ..... 89/45; 89/47

[58] Field of Search ..... 89/33.05, 34, 36.13, 89/45, 46, 47

[56] References Cited

U.S. PATENT DOCUMENTS

| | | | |
|---|---|---|---|
| 536,387 | 3/1895 | McKnight | 89/33.05 |
| 1,602,568 | 10/1926 | Conlon | 89/45 |
| 2,460,384 | 2/1949 | Haas | 89/45 |
| 2,851,928 | 9/1958 | Hultgren et al. | 89/47 |
| 2,933,020 | 4/1960 | Hammer, Jr. | 89/45 |
| 2,975,678 | 3/1961 | Finn | 89/45 |
| 3,238,845 | 3/1966 | Christiansson | 89/46 |
| 3,937,125 | 2/1976 | Eriksson | 89/45 |
| 3,938,421 | 2/1976 | Nordmann | 89/47 |
| 4,011,794 | 3/1977 | Leshem | 89/47 |
| 4,388,854 | 6/1983 | Dabrowski et al. | 89/46 |
| 4,429,616 | 2/1984 | Grosser | 89/36.13 |

FOREIGN PATENT DOCUMENTS

| | | | |
|---|---|---|---|
| 722539 | 7/1942 | Fed. Rep. of Germany | 89/33.05 |

*Primary Examiner*—Stephen C. Bentley
*Attorney, Agent, or Firm*—Bailin Kuch; Robert A. Cahill

[57] ABSTRACT

An autoloader, affixed to a large caliber gun for movement therewith in azimuth and elevation, includes a rammer mounted by a parallel arm linkage mechanism for controlled movement between a lower loading position and an elevated ramming position. While in the loading position, ammunition rounds are singularly released from an ammunition clip to roll by gravity onto a rammer tray for transport to the ramming position. A chain driven ramming pawl then drives the round into the gun breech. A side flap automatically opens to admit a round loaded into the tray and then closes to confine the round on the tray during transport.

13 Claims, 5 Drawing Sheets

18
46
30
44
36
28
22
10
12
24
14
28
31
12
24
30
33
39
38
40
41
42

AUTOLOADING APPARATUS FOR LARGE CALIBER RAPID FIRE GUNS

The present invention relates to armament systems and particularly to apparatus for automating the handling of large caliber ammunition for turret-mounted guns carried by armored vehicles, such as tanks and self-propelled howitzers.

BACKGROUND OF THE INVENTION

Considerable efforts by armament manufacturers throughout the world have been devoted to developing automated apparatus for handling ammunition for large field weapons. This is particularly so in the case of mobile direct and indirect fire weapons carried by armored vehicles, such as tanks and self-propelled howitzers. Presently the tasks of withdrawing rounds from storage and loading them into the breech of a large caliber gun are almost universally performed manually. A gun loader is thus an essential member of military tank crew. Gun firing rate is therefore largely dependent on the ability of the gun loader to expeditiously handle large caliber ammunition which may be thirty six inches in length and weigh as much as ninety five pounds or more.

Of the numerous autoloaders seen in the prior art, most are highly complex, extraordinarily space-consuming, difficult to maintain and susceptible to frequent malfunction. Many of the existing designs require that the gun return to a predetermined position, particularly in elevation, before automated loading can be effected. Thus, the gun must be repeatedly removed from the target for reloading and returned for firing, a significant detriment to firing rate.

SUMMARY OF THE INVENTION

In accordance with the present invention, there is provided improved apparatus for successively loading multiple ammunition rounds into a vehicle-mounted cannon without human intervention. The autoloading apparatus is of an extremely compact construction to operate within an extraordinary small space envelope. Positive control of each round is maintained throughout the process to ensure reliable handling while the vehicle is travelling over rough terrain. The capability of the present invention to load the gun regardless of its position in azimuth and elevation provides for a significant improvement in firing rate.

To achieve these objectives, the autoloader of the present invention includes a base carried by the gun mount for movement with the gun in azimuth and elevation. A carriage is mounted to the base for powered reciprocating movement along a path removed from, but parallel to the gun boreline. A rammer is pivotally connected to the carriage by a pair of parallel arm linkage sets and is connected to the base by pivot links, such that reciprocating movement of the carriage relative to the base articulates the rammer between a depressed position where ammunition rounds are successively loaded onto the rammer and an elevated position from which successive ammunition rounds are rammed into the gun breech.

The base also carries an ammunition clip containing several ammunition rounds which are singularly released to roll by gravity onto a rammer tray each time the rammer returns to the depressed, loading position clear of post-firing gun recoil motion. A tray side flap closes on the ammunition round as it rolls onto the tray to provide lateral restraint on the round as the rammer is elevated to align the round with the gun boreline. A chain driven pawl is then activated to execute a ramming stroke thus propelling the ammunition round into the gun breech. Incident to the rammer's return to its depressed position, the side flap is opened to ready the tray for acceptance of the next round from the clip.

The invention accordingly comprises the features of construction, combination of elements and arrangement of parts, all as described hereinafter and the scope of the invention will be indicated in the claims.

BRIEF DESCRIPTION OF THE DRAWINGS

For a full understanding of the nature and objects of the present invention, reference may be made to the following Detailed Description taken in connection with the accompanying drawings, in which.

Corresponding reference numerals refer to like parts throughout the several views of the drawings.

DETAILED DESCRIPTION

Figure 1:
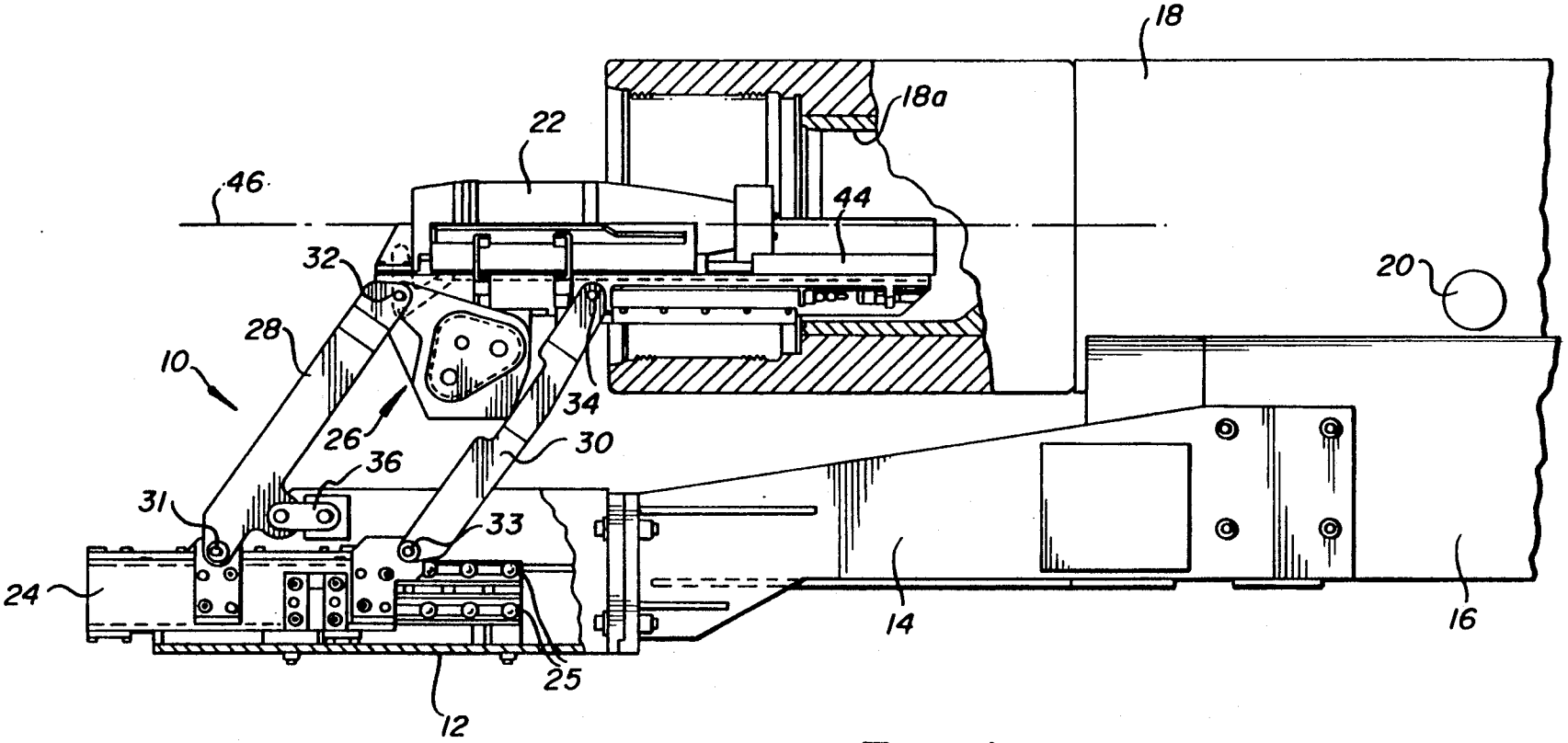
FIG. 1 is a side elevational view, partially broken away, of the autoloading apparatus of the present invention, illustrated in its elevated, ammunition round ramming condition.

The autoloading apparatus of the present invention, generally indicated at 10, includes a base 12 which is affixed to an extension 14 of a revolving turret mount 16 for a large caliber gun 18 movable in elevation about trunnions 20. Thus, the relative position of the base and the breech 18*a* of the gun, which may be a liquid propellant gun, is fixed to permit loading an ammunition round, such as a projectile 22, regardless of gun position in azimuth and elevation or while changing gun position. Base 12, in turn, mounts a carriage 24 via a series of rollers 25 for linear, reciprocating movement. A rammer, generally indicated at 26, is linked to the carriage in pantographic fashion by two transversely aligned sets of parallel arms, one set seen in FIG. 1 as elongated arms 28 and 30. The rearward arms 28 are pivotally connected at one end to the carriage, as indicated at 31, and at their other ends to the rammer, as indicate at 32. The ends of forward arms 30 are similarly pivotally connected to the carriage and rammer, as indicated at 33 and 34, respectively. The rearward arms are also pivotally connected to base 12 by pivot links, one seen at 36 in FIGS. 1 and 2. As seen in FIG. 3, a hydraulic cylinder 38 is pivotally connected to base 12 at 39, while its plunger 40 is pivotally connected to carriage 4 at 41. Upon activation of the hydraulic cylinder, its plunger 40 extends to the left, as seen in FIG. 3, causing the carriage to move linearly to the left, as indicated by arrow 42. By virtue of the pivot link 36 connection of rearward arms 28 to base 12, leftward or rearward motion of the carriage relative to the base causes the arms to swing in the clockwise direction from their collapsed condition of FIG. 2 to their elevated condition of FIG. 1. This motion encompasses both lifting and translating the projectile into the breech through pure translation of the carriage only. This is especially beneficial for liquid propellant guns where the projectile can be placed close to the gun barrel forcing cone. The pantographic arrangement of the arms maintains the centerline of projectile 22 resting on a rammer tray 44 parallel with the boreline 46 of gun 18 while the rammer is in the depressed, projectile-loading position of FIG. 2, as well as during rammer motion into the ramming position where the projectile centerline is aligned with the gun boreline.

Figures 2, 3:
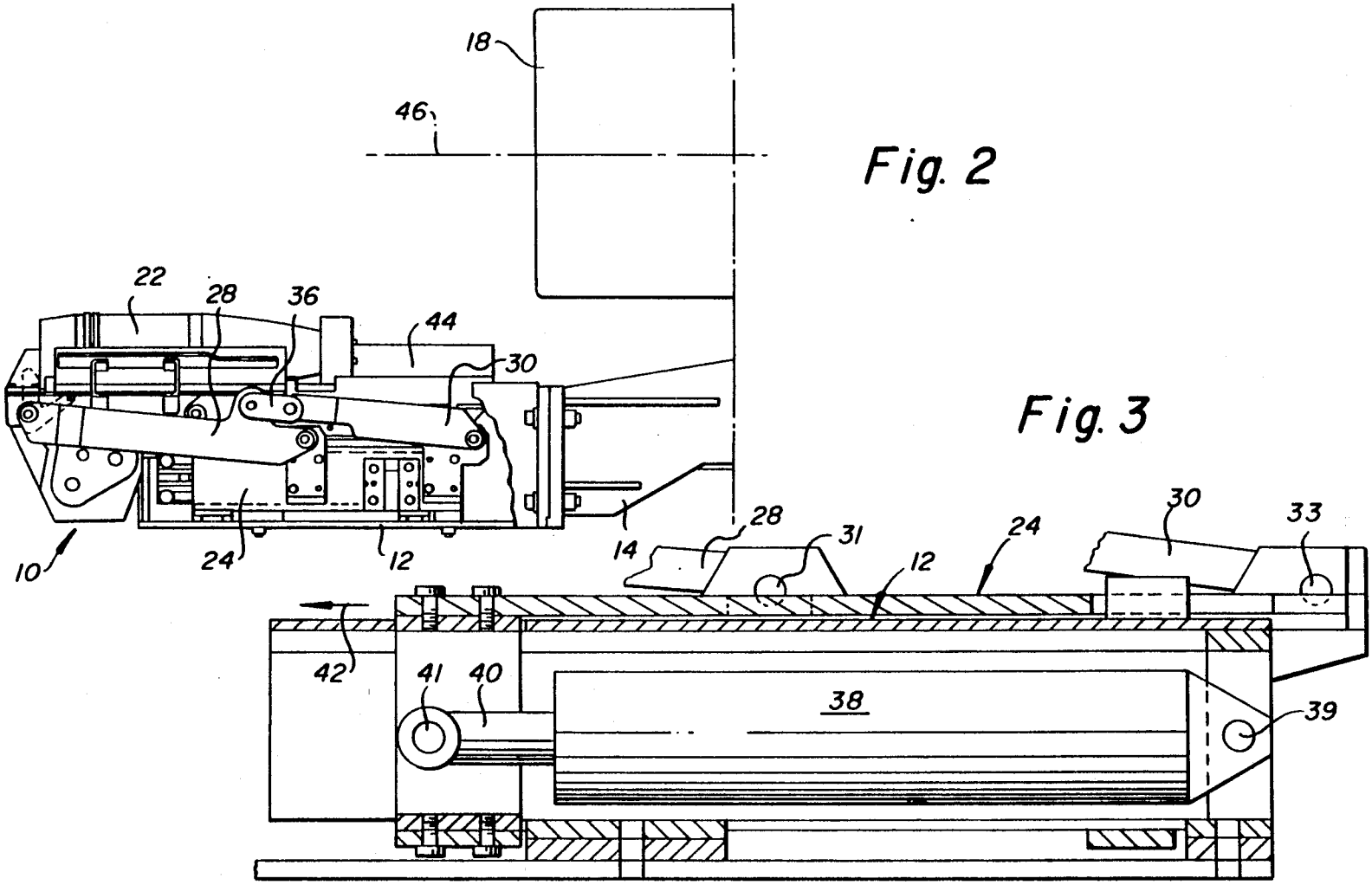
FIG. 2 is frammentary side elevational view, partially broken away, of the autoloading apparatus of FIG. 1, seen in its depressed, ammunition round loading condition.
FIG. 3 is a fragmentary sectional view illustrating the actuator for articulating the autoloading apparatus to its FIGS. 1 and 2 conditions.
Figure 5:
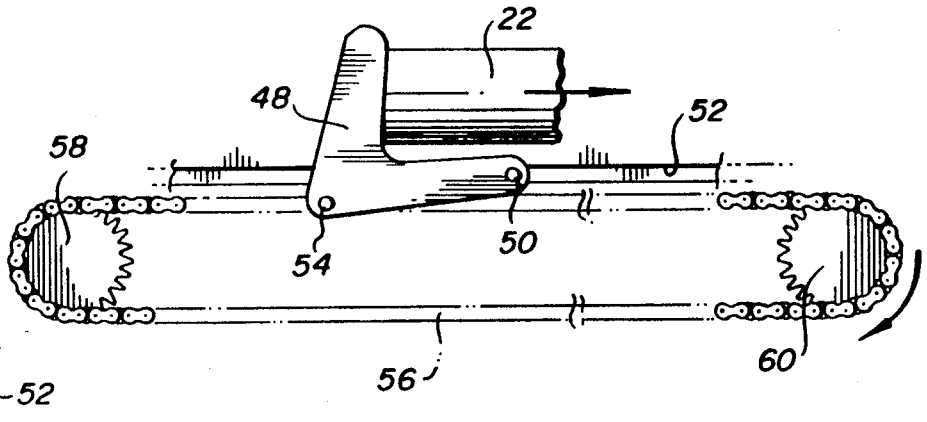
FIGS. 4–6 are simplified, fragmentary side views illustrating representative stages of the ammunition round ramming stroke executed by the autoloading apparatus while in its ramming condition of FIG. 1.
Figure 4:
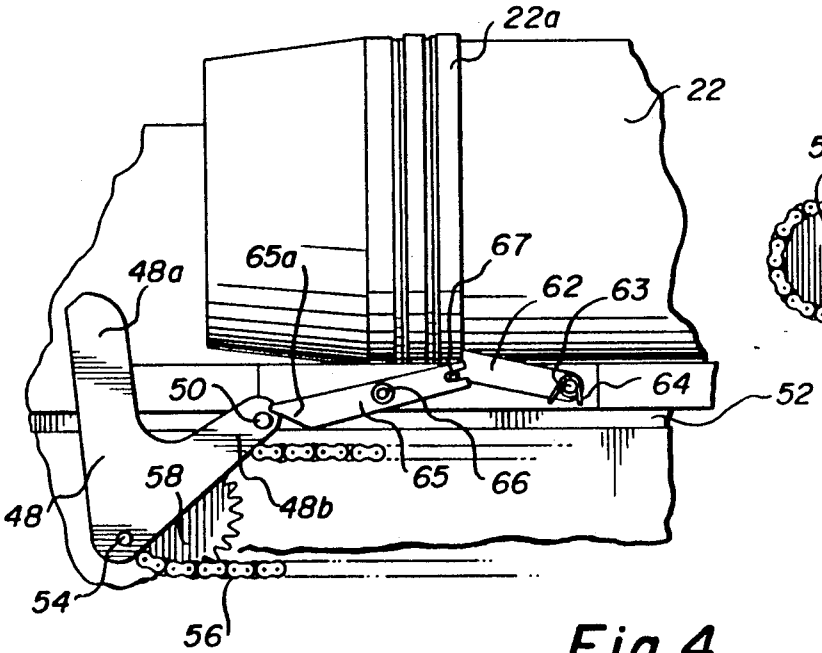
Figure 6:
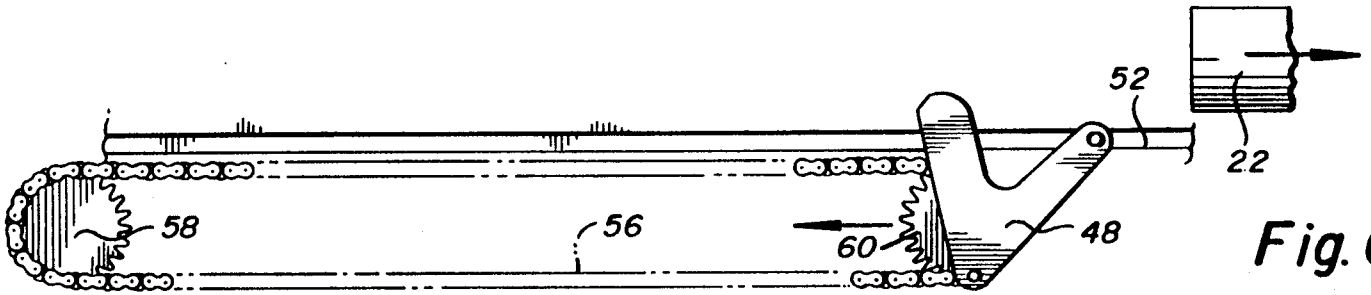

Turning to FIGS. 4–6, when the rammer is in its ramming position, a ramming pawl 48 is driven through a ramming stroke by a chain drive to propel the projectile into the gun breech 18*a* (FIG. 1). The ramming pawl, of a V-shaped configuration, includes a ramming projection 48*a* and an orienting projection 48*b* carrying at its free end a guide pin 50 which runs in a linear channel 52 formed in the projectile holding tray 44 of the rammer 26. The pawl is pivotally connected at 54 to a chain 56 trained around a rear sprocket 58 and a forward sprocket 60, mounted in the rammer housing, to provide an upper run extending parallel to the gun boreline. In practice the ramming pawl chain drive may be provided by a pair of commonly driven transversely aligned chains and sprockets with pawl 48 carried by a pin 54 interconnecting the two chains.

Prior to executing a ramming stroke, forward motion of the projectile during elevation of the rammer is restrained by a stop pawl 62 (FIG. 4) which is pivotally mounted to the rammer by a pin 63 and biased by a torsion spring 64 to elevate its tip into engagement with the forward edge of the projectile's obturator band 22*a*. A link 65, pinned at 66 to the rammer, is provided with a slot for receiving a pin 67 carried by the stop pawl. When the chain drive is activated to begin a ramming stroke, guide pin 50 engages nose 65*a* of link 65 to cam this link in the clockwise direction with the result that stop pawl 62 is depressed to disengage the obturator band, freeing the projectile for a forward ramming stroke. As pin 54 swings clockwise around rear chain sprocket 58 and guide pin 50 moves forward to release stop pawl 62, ramming projection 48*a* of ramming pawl 48 moves into engagement with the projectile base to begin a ramming stroke. FIG. 5 illustrates The orientation of pawl 48 during a ramming stroke dictated by drive pin 54 and guide pin 50 running in channel 52. FIG. 6 illustrates the conclusion of the powered ramming stroke, wherein drive pin 54 has travelled around forward sprocket 60 to begin its return of the ramming pawl to the start position of FIG. 4.

Figure 7:
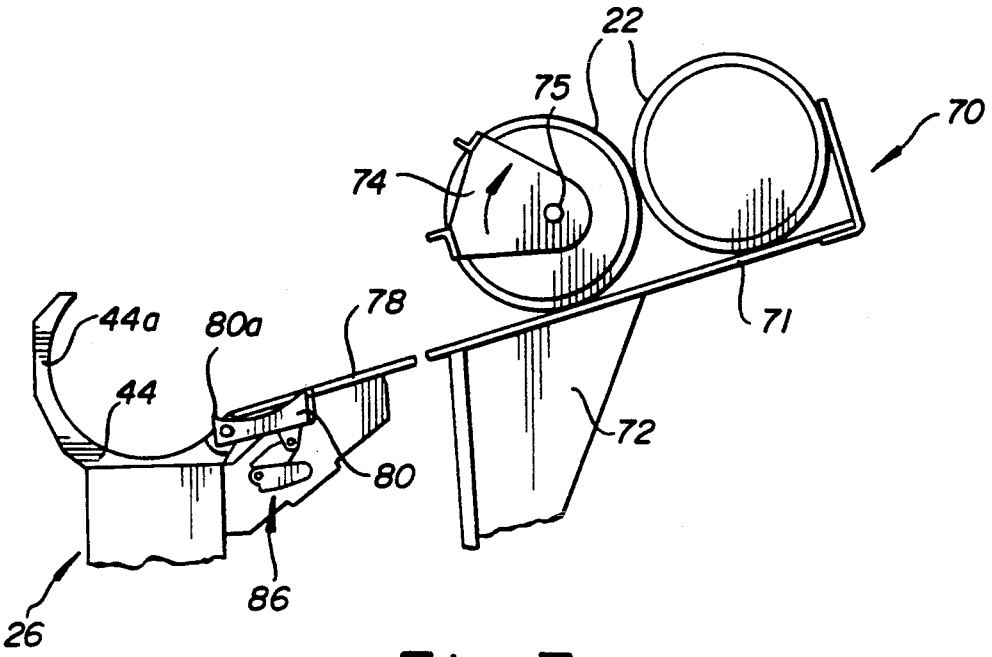
FIGS. 7 and 8 are simplified fragmentary end views illustrating the loading of ammunition rounds while the autoloading apparatus is in its depressed condition of FIG. 2.
Figure 8:
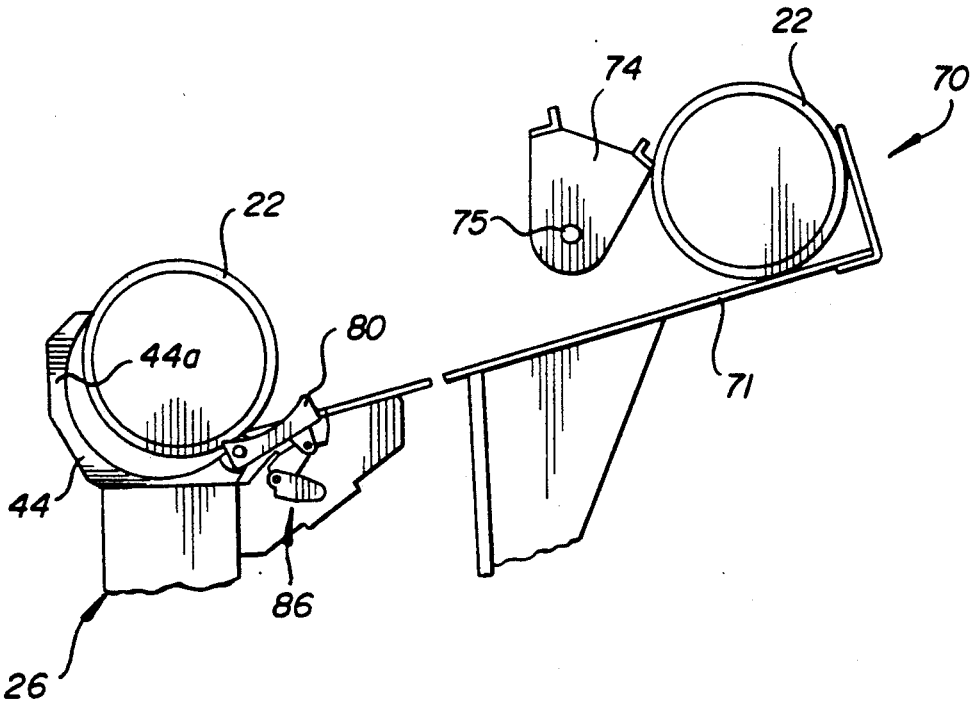

Once the gun is loaded, rammer 26 is returned to its loading position of FIG. 2, clearing the way for closure of the breech, firing of the gun and the consequent recoil FIGS. 7 and 8 illustrate the loading of projectiles onto rammer 26 from a projectile clip, generally indicated at 70. This clip includes an inclined platform 71 for supporting several projectiles 22, e.g., two projectiles. This platform is supported by an extension 72 of base 12. The projectiles are retained on the platform by a release member 74 mounted for oscillation by a shaft 75. The release member acts on the leading or lowest projectile resting on inclined platform 71. To release the leading projectile, the release member 74 is rotated in the clockwise direction from its position of FIG. 7 to its position of FIG. 8. This motion is seen to release the leading projectile to roll off the platform, while preventing the trailing projectile from rolling down the platform. When the release member is then rotated back to its position of FIG. 7, the trailing projectile is permitted to roll down the platform to the leading projectile position where it is held by the release member. It is thus seen that this simple oscillating release member 74 is effective to gravity feed one projectile at a time to the rammer.

Figure 9:
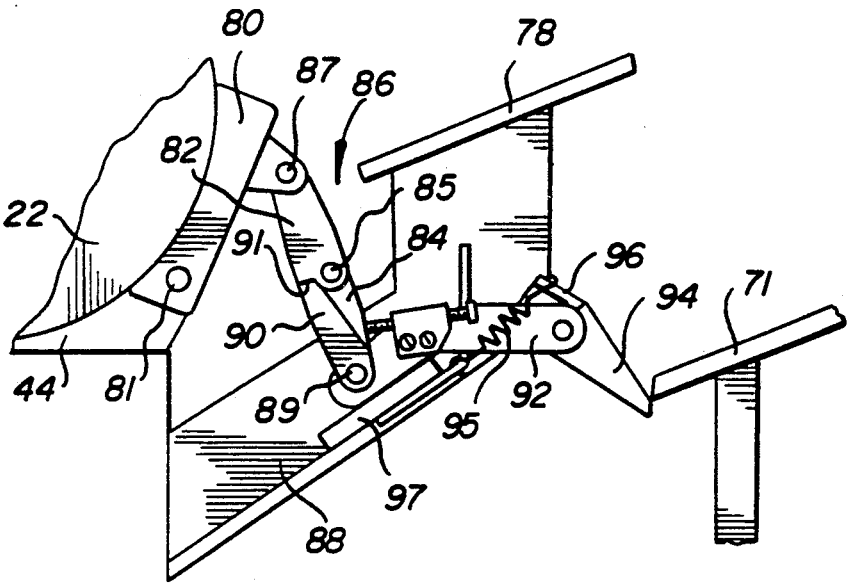
FIGS. 9 and 10 are fragmentary end views illustrating events occurring as the autoloading apparatus articulates between its conditions of FIGS. 1 and 2.

Still referring to FIGS. 7 and 8, rammer 26 carries an inclined apron 78 which serves as a continuum of platform 71 when the rammer is in its projectile loading position of FIG. 2. Thus, a leading projectile freed by release member 74 rolls down platform 71 and apron 78 into rammer tray 44. To cooperate with the fixed side 44*a* of the tray in providing lateral restraint for a loaded projectile, the rammer is equipped with an articulating side flap 80. This side flap assumes an open position seen in FIG. 7 to clear the way for a projectile to roll over apron 78 into tray 44. In response to passage of the projectile, the side flaps swings to the closed and latched position of FIG. 9 in opposed relation with the tray fixed side 44*a* to fully laterally confine the projectile on the tray. To this end, side flap 80 is pivotally mounted to tray 44 along its lower edge by a hinge pin 81, as best seen in FIG. 9. A pair of links 82 and 84 are pivotally interconnected by a knee pin 85 to form a toggle linkage, generally indicated at 86. The free end of link 82 is pivotally connected to side flap 80 by a pin 87, while the free end of link 84 is pivotally connected to apron mounting bracket 88 by a pin 89. Link 84 is provided with a tang 90 which engages a shoulder 91 on link 82 to hold the toggle linkage 86 in a straightened, over-center condition to latch the side flap in its closed position.

Returning to FIGS. 7 and 8, as a projectile rolls over apron 78 into tray 44, it engages a projecting lower edge 80*a* of side flap 80 in its open position. This engagement forces the side flap to swing in a counter- clockwise, closing direction following the projectile onto the tray. The collapsed toggle linkage begins to straighten and ultimately assumes the straightened, over- center condition of FIG. 9, latching the side flap in its closed position.

To unlatch the side flap from its closed position, a laterally extending arm 92 is pivotally mounted by toggle pin 89 and, in turn, pivotally mounts at its free end a lever 94. A tension spring 95 hooked between the apron bracket and the lever biases the latter to an inline position with arm 92 established by engagement of a laterally turned tab 96 of the lever against the upper edge of arm 92 and also urges the arm to a clockwise most position against a stop 97 carried by apron bracket 88. Arm 92 also carries a sleeve 98 through which an adjustment bolt 99 is threaded to position its tip against the edge of toggle link 84 at a point below knee pin 85 when the toggle linkage 86 is in its straightened, over-center condition.

Figure 10:
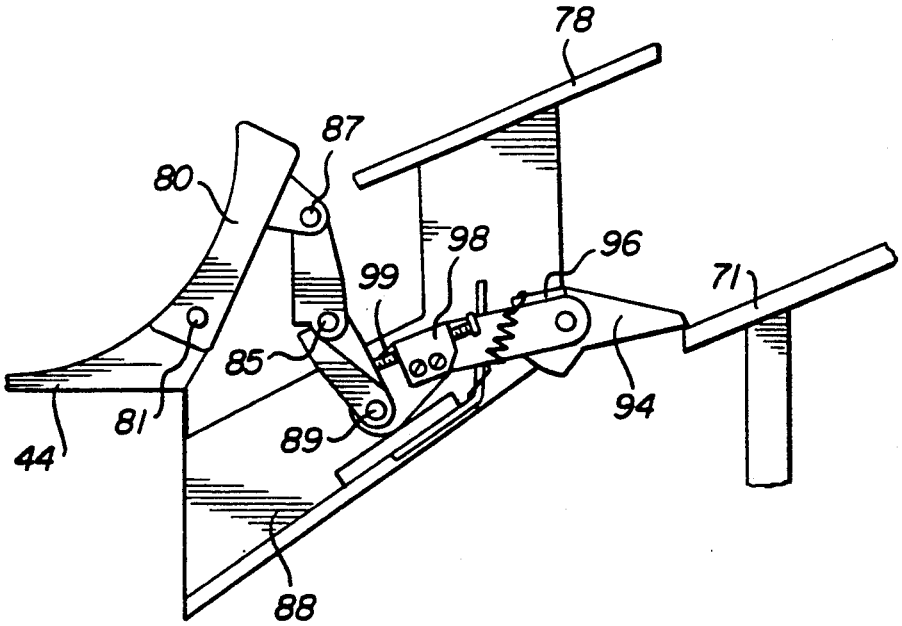

From FIGS. 9 and 10, it is seen that the tip of lever 94 in its inline position with arm 92 extends beyond the lower end of platform 71 of projectile clip 70. Thus, when the rammer is being raised to its ramming position and side flap 80 is closed and latched by the toggle linkage, lever 94 moves into engagement with ramp 71. However, spring 95 yields to permit the lever to be deflected in the clockwise direction to clear the platform, as illustrated in FIG. 9.

When the empty rammer is being lowered to its loading position, lever 94 again encounters platform 71. However, in this case tab 96 precludes counter clockwise pivotal movement of the lever, and thus the only way the platform can be cleared is by counter clockwise pivotal motion of arm 92 about pin 89. This arm motion, illustrated in FIG. 10, causes bolt 99 to push the toggle linkage knee pin 85 leftward through the centerline between pins 87 and 89, and side flap swings by its own weight to its open position as the toggle linkage collapse. The way is then cleared to load the next projectile onto the rammer tray upon arrival at the full-down loading position.

From the foregoing description, it is seen that the present invention provides an autoloading apparatus capable of rapidly loading a large caliber gun in a highly efficient and expeditions manner. With a projectile loaded in the gun and two projectiles waiting in clip 70, burst fire capability can be achieved, e.g., firing three projectiles within twenty seconds. The parallel arm controlled motion of the rammer between its ramming and loading positions can be accomplished quickly and accurately within a compact space envelope and over a wide range of gun elevation angles. Suitable deceleration buffers (not shown) are utilized to bring the rammer rapidly to controlled stops precisely at its full-up ramming position and its full-down projectile loading position. Microswitches sense the arrival of a projectile on the rammer tray, the achievements of the extreme rammer positions, the opening of the gun breech, and the return of the rammer pawl to its rearward start position, such that the various steps in the operating sequence are initiated as soon as possible to achieve the requisite burst fire rate.

It is thus seen that the objectives set forth, including those made apparent from the Detailed Description, are efficiently attained, and, since certain changes may be made in the construction set forth without departing from the scope of the invention, it is intended that matters of detail be taken as illustrative and not in a limiting sense.

Having described the invention, what is claimed as new and desired to secure by Letters Patent is:

1. Autoloading apparatus for a large caliber gun comprising, in combination:

A. a base mounted to the gun for movement therewith in azimuth and elevation;

B. a carriage mounted by the base for reciprocating linear motion;

C. a rammer mounted by said carriage for movement between a gun ramming position and loading position clear of gun recoil motion in response to reciprocating motion of said carriage;

D. a tray carried by said rammer for receiving an ammunition round while said rammer is in said loading position;

E. ramming means carried by said rammer for propelling an ammunition round from said tray into the gun breech while said rammer is in said ramming position;

F. an ammunition clip mounted by said base for holding ammunition rounds preparatory to being loaded on said tray, said ammunition clip including an inclined platform for supporting plural ammunition rounds and a release mechanism for releasing successive ammunition rounds, each released ammunition round rolling off said platform and onto said tray while said rammer is in said loading position; and G. a side flap pivotally mounted for swinging movement between an open position to admit an ammunition round rolling from said platform onto said tray and a closed position to laterally restrain an ammunition round on said tray during rammer movement from said loading position to said ramming position.

2. The autoloading apparatus defined in claim 1, wherein said rammer further includes a side flap latching mechanism responsive to an ammunition round rolling onto said tray for latching said side flap in said closed position and responsive to movement of said rammer from said ramming position to said loading position for unlatching said side flap for swinging movement to said open position.

3. The autoloading apparatus defined in claim 2, wherein said side flap includes an actuating portion engaged by an ammunition round rolling onto said tray to propel said side flap from said open position to said closed position, said latching mechanism including a toggle linkage pivotally connected between said side flap and said rammer, said toggle linkage assuming a collapsed condition with said side flap in said open position and a straightened, latch condition with said side flap in said closed position.

4. The autoloading apparatus defined in claim 3, wherein said latching mechanism further includes an actuating arm positioned to articulate said toggle linkage to said collapsed condition and unlatch said side flap for movement to said open position upon striking an object during rammer motion from said ramming position to said loading position.

5. The autoloading apparatus defined in claim 1, wherein said release mechanism includes a release member mounted for oscillating movement between first and second positions, said release member, in said first position, engaging an ammunition round in a leading position on said platform and, in said second position, engaging an ammunition round in a trailing position on said platform, said release member releasing the ammunition round from said leading position to roll onto said tray during movement from said first position to said second position and releasing the ammunition round from said trailing position to roll into said leading position during movement from said second position to said first position.

6. The autoloading apparatus defined in claim 1, which further includes a parallel arm linkage for pivotally mounting said rammer to said carriage and a pivot link connecting said parallel arm linkage to said base, whereby, upon reciprocating motion of said carriage relative to said base along a path parallel to the boreline of the gun, said rammer is articulated between said ramming and loading positions while maintaining said tray oriented in parallel relation with the gun boreline, such that the centerline of an ammunition round on said tray can be aligned with the gun boreline when said rammer is in said ramming position.

7. The autoloading apparatus defined in claim 6, wherein said rammer further includes a side flap pivotally mounted for swing movement between an open position to admit an ammunition round rolling from said platform onto said tray and a closed position to laterally restrain an ammunition round on said tray during rammer movement from said loading position to said ramming position.

8. The autoloading apparatus defined in claim 7, wherein said rammer further includes a side flap latching mechanism responsive to an ammunition round rolling onto said tray for latching said side flap in said closed position and responsive to movement of said rammer from said ramming position to said loading position for unlatching said side flap for swinging movement to said open position.

9. The autoloading apparatus defined in claim 8, wherein said side flap includes an actuating portion engaged by an ammunition round rolling onto said tray to propel said side flap from said open position to said closed position, said latching mechanism including a toggle linkage pivotally connected between said side flap and said rammer, said toggle linkage assuming a collapsed condition with said side flap in said open position and a straightened, latch condition with said side flap in said closed position.

10. The autoloading apparatus defined in claim 9, wherein said latching mechanism further includes an actuating arm positioned to articulate said toggle linkage to said collapsed condition and unlatch said side flap for movement to said open position upon striking an object during rammer motion from said ramming position to said loading position.

11. The autoloading apparatus defined in claim 10, wherein said release mechanism includes a release member mounted for oscillating movement between first and second positions, said release member, in said first position, engaging an ammunition round in a leading position on said platform and, in said second position, engaging an ammunition round in a trailing position on said platform, said release member releasing the ammunition round from said leading position to roll onto said tray during movement from said first position to said second position and releasing the ammunition round from said trailing position to roll into said leading position during movement from said second position to said first position.

12. The autoloading apparatus defined in claim 6, wherein said ramming means includes a drive chain trained around forward and rear sprockets and a ramming pawl pinned to said chain for propulsion from a start position adjacent said rear sprocket through a ramming stroke concluded adjacent said forward sprocket, said pawl carrying a guide pin running in a linear channel formed in said rammer and extending parallel to the gu boreline for orienting said pawl in ramming engagement with the base of an ammunition round during a ramming stroke.

13. The autoloading apparatus defined in claim 12, wherein said ramming means further includes a stop pawl biased into engagement with an ammunition round on said tray to restrict forward movement thereof, said stop pawl being deflected into disengaged relation with an ammunition round incident to movement of said ramming pawl away from said start position to begin a ramming stroke.

* * * * *